US007419163B2

(12) United States Patent
Hartwig et al.

(10) Patent No.: US 7,419,163 B2
(45) Date of Patent: Sep. 2, 2008

(54) DARTBOARD COVER

(75) Inventors: Matthew T. Hartwig, Lansdale, PA (US); Gary D. Giegerich, Glenside, PA (US)

(73) Assignee: DMI Sports, Inc., Fort Washington, PA (US)

( * ) Notice: Subject to any disclaimer, the term of this patent is extended or adjusted under 35 U.S.C. 154(b) by 0 days.

(21) Appl. No.: 11/621,378

(22) Filed: Jan. 9, 2007

(65) Prior Publication Data

US 2007/0158912 A1 Jul. 12, 2007

Related U.S. Application Data

(60) Provisional application No. 60/757,758, filed on Jan. 10, 2006.

(51) Int. Cl.
*F41J 3/00* (2006.01)

(52) U.S. Cl. ..... 273/403

(58) Field of Classification Search ..... 273/348.3, 273/371–376, 403, 404, 407–409
See application file for complete search history.

(56) References Cited

U.S. PATENT DOCUMENTS

| | | | | | |
|---|---|---|---|---|---|
| 2,039,352 | A * | 5/1936 | Ross | 273/407 |
| 2,170,850 | A * | 8/1939 | Bonnett et al. | 273/403 |
| 3,504,913 | A * | 4/1970 | Bilotti | 273/407 |
| 3,542,365 | A * | 11/1970 | Gantz | 273/407 |
| 3,891,214 | A * | 6/1975 | Scullin | 273/408 |
| 4,281,836 | A * | 8/1981 | Black | 273/408 |
| 5,540,446 | A * | 7/1996 | Felsen | 273/403 |
| 6,045,132 | A * | 4/2000 | Giegerich | 273/408 |
| 6,073,931 | A * | 6/2000 | Voden | 273/404 |
| 2004/0032087 | A1 * | 2/2004 | Kim | 273/348.3 |
| 2005/0093242 | A1 * | 5/2005 | Lai | 273/408 |

* cited by examiner

*Primary Examiner*—Mark S Graham
(74) *Attorney, Agent, or Firm*—Panitch Schwarze Belisario & Nadel LLP

(57) ABSTRACT

A dartboard cover for covering a dartboard in an aesthetically pleasing manner wherein the dartboard cover includes a frame having a central aperture and a graphic panel removably mountable in the central aperture. A rib extends from a rear surface of the frame and is removably engagable with an upper edge of the dartboard to removably mount the dartboard cover to the dartboard.

13 Claims, 1 Drawing Sheet

DARTBOARD COVER

CROSS-REFERENCE TO RELATED APPLICATIONS

This application claims the benefit of U.S. Provisional Patent Application No. 60/757,758, which was filed Jan. 10, 2006, is entitled "Dartboard Cover" and is incorporated herein by reference in its entirety.

BACKGROUND OF THE INVENTION

Present invention relates generally to a cover for a dartboard and, more particularly, to a dartboard cover that is adaptable for displaying various graphics to create a desired ornamental appearance as opposed to an exposed dartboard on a wall. Dartboard cabinets are commercially available and relatively well known by those skilled in the art of darts and dart supplies. A typical dartboard cabinet is rectangular, constructed of wood and fixed to a wall at a predetermined dartboard playing height. The dartboard cabinet typically includes a pair of hinged front doors that alternately cover and expose a dartboard that is mounted within the cabinet. The hinged doors may include a scoreboard on an inner surface and an outer surface of the doors may include a carved or painted image that is permanently adhered to the doors and is not adaptable to modification.

It would be desirable to develop a dartboard cover that is not fixed to the wall, thereby requiring holes in the wall, is generally lightweight and includes a high quality or other graphic that is adaptable to user preferences.

BRIEF SUMMARY OF THE INVENTION

Briefly stated, the present application is directed to a dartboard cover for covering a dartboard in an aesthetically pleasing manner. The dartboard cover includes a frame having a central aperture and a rib extending from a rear surface of the frame. The rib is removably engagable with an upper edge of the dartboard to removably mount the dartboard cover to the dartboard. A graphic panel is removably mountable in the central aperture.

In another aspect, the present application is directed to a dartboard cover for covering a dartboard in an aesthetically pleasing manner. The dartboard cover includes a frame having a central aperture in a front wall, a first side wall, a second side wall and a top wall. A rib extends from a rear surface of the front wall and is removably engagable with an upper edge of the dartboard to removably mount the dartboard cover to the dartboard. A plurality of pivoting lock arms are mounted to the rear surface of the frame proximate the central aperture. A graphic panel is removably mountable to the central aperture and is secured to the frame by the pivoting lock arms in an assembled configuration.

BRIEF DESCRIPTION OF THE SEVERAL VIEWS OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
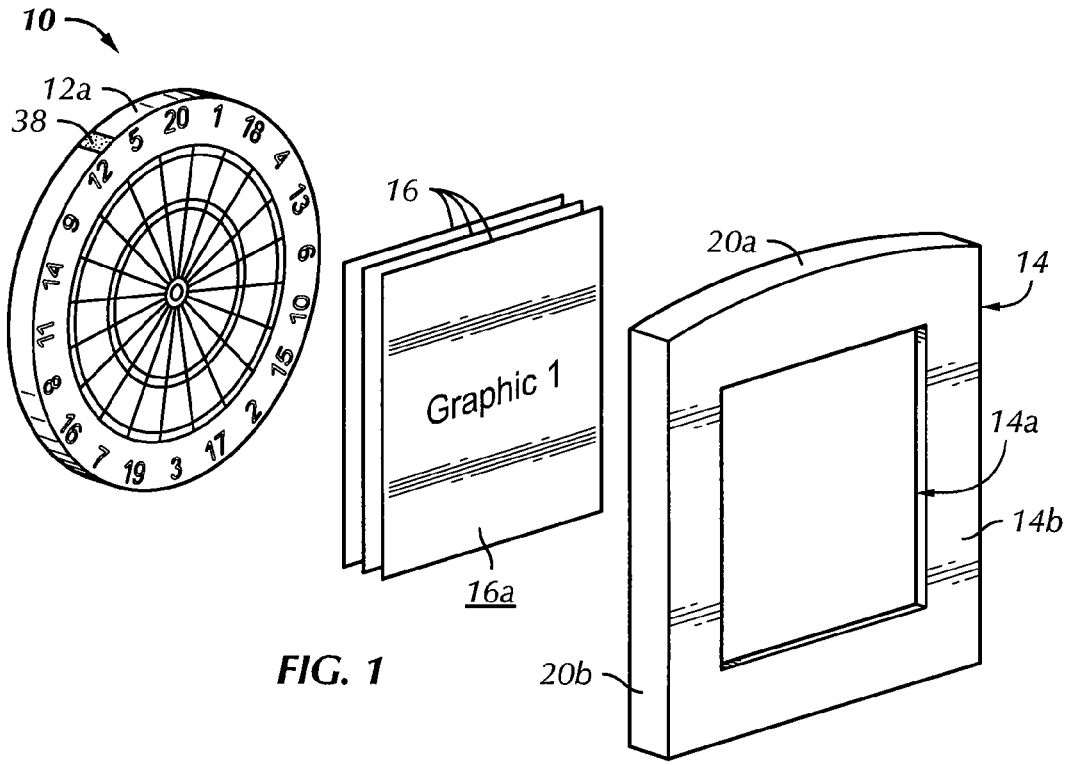
FIG. 1 is a top perspective, partially exploded view of a dartboard cover for covering a dartboard in accordance with a preferred embodiment of the present invention.

Certain terminology is used in the following description for convenience only and is not limiting. The words, "right", "left", "lower" and "upper" designate directions in the drawings to which reference is made. The words, "inwardly" and "outwardly" refer to directions toward and away from, respectively, the geometric center of the dartboard cover and designated parts thereof. The terminology includes the words above specifically mentioned, derivatives thereof, and words of similar import. Additionally, the word, "a", as used in the specification, means at least one.

Figure 2:
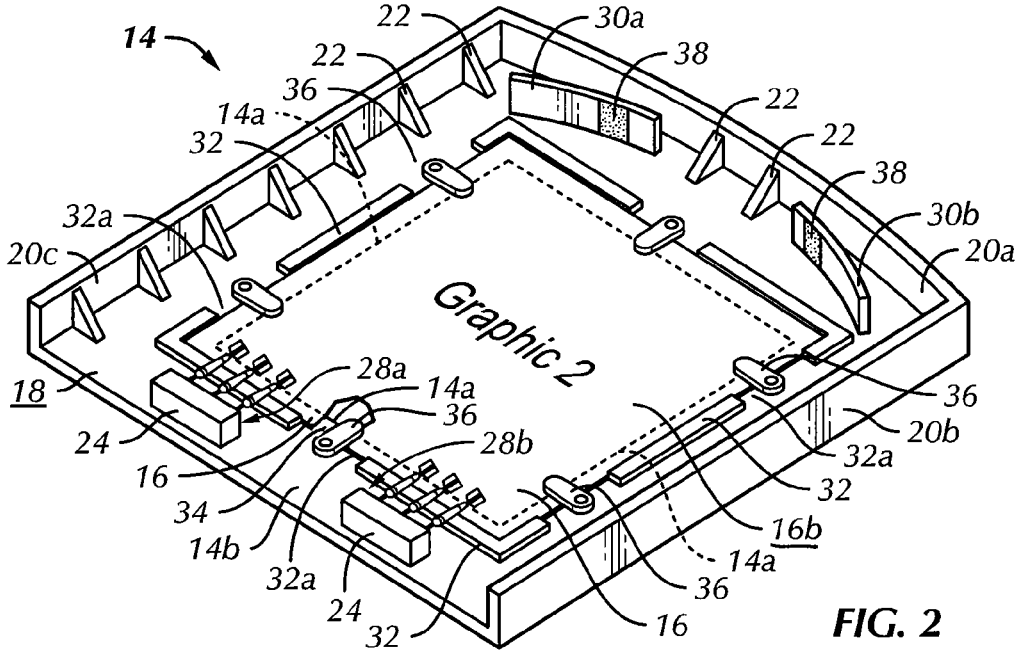
FIG. 2 is a rear perspective view of the dartboard cover shown in FIG. 1.

Referring to the drawings in detail, wherein like numerals indicate like elements throughout, there is shown in FIGS. 1 and 2, a preferred embodiment of a dartboard cover, generally designated 10, for covering a dartboard 12 in an aesthetically pleasing manner.

Referring to FIGS. 1 and 2, the dartboard cover 10 includes a frame 14 having a central aperture 14*a* and a graphic panel 16 that is removably mountable for exposure from the central aperture 14*a*. In the preferred embodiment, the frame 14 includes a front wall 14*b* that accommodates the aperture 14*a* and also has a rear surface 18. The frame 14 further preferably includes a first side wall 20*a*, a second side wall 20*b* and a top wall 20*c*. The top wall 20*a* preferably has an arcuate-shape that extends from edges away from a center of the frame 14 at a mid-portion to accommodate the circular shape of the dartboard 12 in a mounted position, as would be apparent to one having ordinary skill in the art. The top wall 20*c* is not limited to having an arcuate-shape and may have a generally linear shape or nearly any shape that is desired by a user or producer, for example, to provide a preferred ornamental appearance for the dartboard cover 10. In addition, the frame 14 is not limited to inclusion of the first side wall 20*a*, the second side wall 20*b* and the top wall 20*c* and may be constructed without any walls; however, the walls 20*a*, 20*b*, 20*c* are preferred to cover the dartboard 12 in the mounted position and potentially to space the dartboard cover 10 from the wall that the dartboard 12 is mounted to.

Referring to FIG. 2, in the preferred embodiment, the frame 14 including the front wall 14*b*, the first side wall 20*a*, the second side wall 20*b* and the top wall 20*c* are integrally molded using a generally rigid, polymeric material. The frame 14 including the front wall 14*b*, first side wall 20*a*, second side wall 20*b* and top wall 20*c* is not limited to being integrally molded or to be constructed of a generally rigid, polymeric material. The frame 14 and associated walls 14*b*, 20*a*, 20*b*, 20*c* may be constructed of nearly any generally rigid structural material such as wood, metal or nearly any other material that is able to take on the general size and shape of the frame 14 and withstand the normal operating conditions of the frame 14.

The frame 14 preferably includes stiffening ribs 22 located between the front wall 14*b* and the top, first side and second side walls 20*a*, 20*b*, 20*c* to provide strength and stiffness to the frame 14. The stiffening ribs 22 are preferably integrally molded with the frame 14 but are not so limited and may be secondary components bonded to or otherwise secured to the frame 14 to provide stiffness to the frame 14 and, specifically, between the front wall 14*b* and the first side, second side and top walls 20*a*, 20*b*, 20*c*. In addition, the frame 14 may be constructed without inclusion of the stiffening ribs 22. The stiffening ribs 22 are preferably constructed of the rigid, polymeric material of the frame 14 when the stiffening ribs 22 are integrally molded with the frame 14 but may be constructed of nearly any rigid, structural material that is able to take on the general configuration and function of the stiffening ribs 22 and withstand the normal operating conditions of the stiffening ribs 22 or may not be included in the frame 14.

The preferred dartboard cover 10 includes a first dart holder 24 and a second dart holder 26 mounted to the frame 14. The first and second dart holders 24, 26 accommodate darts 28*a*, 28*b* for use with the dartboard 12 during game play. The preferred first and second dart holders 24, 26 have a generally boxy shape and are configured to accept the tips of the darts 28*a*, 28*b* in a storage configuration (FIG. 2). The first and second dart holders 24, 26 may be integrally molded with the frame 14 or may be bonded or otherwise mounted to the frame 14 following the preferred molding of the frame 14. The first and second dart holders 24, 26 provide a storage place for the darts 28*a*, 28*b* when the dartboard 12 is not in use to generally limit loss of the darts 28*a*, 28*b*, specifically, because the darts 28*a*, 28*b* are typically unable to be stored in the dartboard 12 when the dartboard cover 10 is positioned on the dartboard 12. The dartboard cover 10 is not limited to inclusion of the first and second dart holders 24, 26 nor to the specific type of dart holders 24, 26 that are shown in FIG. 2. For example, the frame 14 may include a clamp-type dart holder or a shelf (neither shown) that provide for a storage space for the darts 28*a*, 28*b* on the dartboard cover 10 when the darts 28*a*, 28*b* are not being used. The first and second dart holders 24, 26 are convenient for separating the darts 28*a*, 28*b* of different players but are not limited in this manner.

The frame 14 of the dartboard cover 10 also includes a rib 30 extending from the rear surface 18 that is removably engagable with an upper edge 12*a* of the dartboard 12 to removably mount the dartboard cover 10 to the dartboard 12. The rib 30 preferably extends generally perpendicularly from the rear surface 18 and has an arcuate or contoured-shape to generally conform to the shape of the top edge 12*a*. The rib 30 is preferably integrally molded with the frame 14 but is not so limited and may be subsequently bonded or mounted to the frame 14 or otherwise formed on the frame 14. In addition, the rib 30 is not limited to extending generally perpendicularly from the rear surface 18 and may extend at an angle relative to the rear surface 18 or in nearly any configuration that permits the rib 30 to grasp or engage the dartboard 12 to secure the dartboard cover 10 to the dartboard 12. For example, the rib 30 may be comprised of spikes or pins that extend into the dartboard 12 to secure the dartboard cover 10 to the dartboard 12 in the mounted position. In addition, the rib 30 may be constructed of a metallic, wooden or other rigid, structural material that releasably engages the top edge 12*a* to mount of the dartboard cover 10 to the dartboard 12 through the force of gravity.

In the preferred embodiment, the rib 30 is comprised of a first arcuate rib 30*a* and a second arcuate rib 30*b* extending generally perpendicularly from the rear surface 18. The first and second ribs 30*a*, 30*b* preferably conform to the general shape of the top edge 12*a* or a portion of the top edge 12*a* such that the ribs 30*a*, 30*b* may be engaged with the top edge 12*a* to hang or mount the frame 14 to the dartboard 12. The first and second ribs 30*a*, 30*b* are separated in the preferred embodiment to accommodate the stiffening ribs 22 between the front wall 14*b* and the top wall 20*c* but are not limited to being separated. For example, the first and second ribs 30*a*, 30*b* may be comprised of a continuous rib proximate the top wall 20*c* or a continuous, cylindrical rib that extends around the entire aperture 14*a* to secure the frame 14 to the dartboard 12. In addition, the rib 30 may be comprised of pins or alternative mechanisms that mount the frame 14 to the dartboard 12. However, the first and second arcuate-shaped ribs 30*a*, 30*b* are preferred to accommodate the stiffening ribs 22 between the top wall 20*c* and the front wall 14*b* and provide relatively simple mounting of the frame 14 to the dartboard 12, as will be described in greater detail below.

A panel alignment rib 32 preferably extends generally perpendicularly from the rear surface 18 proximate a periphery of the aperture 14*a* to define a panel shelf 34 that receives the graphic panel 16 in an assembled configuration. The panel alignment rib 32 is preferably integrally molded with the frame 14 but is similarly not limiting as is described above for the ribs 30*a*, 30*b* and walls 20*a*, 20*b*, 20*c*. The preferred panel alignment rib 32 is also discontinuous to accommodate a panel mounting mechanism or pivoting lock arms 36, as will be described in greater detail below. The panel alignment rib 32 is not limited to being discontinuous to accommodate the panel mounting mechanisms 36 and may be continuous or may be eliminated from the frame 14 but is preferably included in the frame 14 to aid in aligning the graphic panel 16 with the frame 14 and, specifically, the aperture 14*a*. In the preferred embodiment, a peripheral edge of the graphic panel 16 abuts the panel alignment rib 32 to align the graphic panel 16 with the aperture 14*a* and the panel shelf 34 aids in securing the graphic panel 16 in a proper position relative to the aperture 14*a*.

The panel mounting mechanisms or pivoting lock arms 36 are preferably secured to the rear surface 18 of the frame 14 proximate the central aperture 14*a* within discontinuities 32*a* of the panel alignment rib 32. The discontinuities 32*a* provide space for the pivoting lock arms 36 to pivot relative to the front wall 14*b* between a locking position (FIG. 2) and a release position (not shown). The panel mounting mechanisms 36 are not limited to being comprised of the pivoting lock arms 36 shown in FIG. 2 and may be comprised of nearly any mechanism that is able to secure the graphic panel 16 to the front wall 14*b* or rear surface 18 such that the graphic panel 16 is exposed from the aperture 14*a*. For example, the panel mounting mechanism 36 may be comprised of hook and loop material, fasteners, adhesive, clips or a portion of the panel alignment rib 32 that overhangs the panel shelf 34 to secure the graphic panel 16 to the rear wall 18. However, the pivoting lock arms 36 are preferred for their relative simplicity and reliability in securing the graphic panel 16 to the frame 14. The frame 14 preferably includes six pivoting lock arms 36 to releasably mount the graphic panel 16 to the frame 14 but is not so limited and may include nearly any number of pivoting lock arms or nearly any type of panel mounting mechanism 36 to releasably mount the graphic panel 16 to the frame 14.

The graphic panel 16 preferably includes a first display surface 16*a* and a second display surface 16*b* wherein a first graphic Graphic 1 is printed on the first surface 16*a* and a second graphic Graphic 2 is printed on the second surface 16*b*. The first and second display surfaces 16*a*, 16*b* are not limited to including printed graphics thereon and may include or be comprised of a blank surface, a painted graphic or a surface that includes nearly any high quality ornamental picture or representation that is desired by a user to create a specific ornamental appearance. For example, the first and second display surfaces 16*a*, 16*b* may be decorated by markers utilized by a user and that are able to be cleaned or wiped off of the surfaces 16*a*, 16*b* to modify the ornamental appearance or may have magnetic properties for a user to attach ornamental magnets thereon. In addition, the first or second display surfaces 16*a*, 16*b* and graphic panel 16 may include holes therethrough to expose certain portions of the dartboard 12 to create an alternative ornamental appearance.

The preferred graphic panel 16 and the central aperture 14*a* have a generally rectangular configuration wherein the graphic panel 16 is slightly larger than the central aperture 14*a*. The graphic panel 16 being slightly larger than the central aperture 14*a* permits a peripheral portion of the graphic panel 16 to engage the panel shelf 34 in the assembled configuration such that the pivoting lock arms 36 are able to secure or lock the graphic panel 16 to the frame 14 in the assembled configuration. The graphic panel 16 and the aperture 14*a* are not limited to having a generally rectangular shape or to the graphic panel 16 being larger than the central aperture 14*a* and may have nearly any shape and/or size that permits the graphic panel 16 to be displayed from the central aperture 14*a* and secured to the frame 14. For example, the central aperture 14*a* may have a circular shape and the graphic panel may be slightly smaller than the central aperture 14*a* and alternatively secured to the frame 14 to expose portions of the dartboard 12 through the central aperture 14*a*.

Referring to FIG. 1, the dartboard cover 10 may also include a plurality of additional graphic panels 16 that are removably mountable to the frame 14 to display a graphic surface from the central aperture 14*a*. The plurality of additional graphic panels 16 preferably have an identical size and shape to the graphic panel 16 and include alternative ornamental appearances on their surfaces such that a user is able to modify the ornamental appearance of the dartboard cover 10, as desired. For example, one of the additional plurality of graphic panels 16 may have a generally blank surface that functions as a "white board" for keeping score or the plurality of additional graphic panels 16 may have printing thereon that represents a scoring grid or map of specific dart games, such as 301, as would be apparent to one having ordinary skill in the art. In addition, the plurality of additional graphic panels 16 may include alternative advertising or other graphics thereon that are displayed by a user in specific situations or time periods and allow the dartboard cover 10 to be adaptable to user preferences. Accordingly, the plurality of graphic panels 16 provide adaptability for displaying various graphics from the central aperture 14*a* when the frame 14 is mounted to the dartboard 12 or may include graphic panels 16 that are adaptable for use in keeping score for various dart games.

Referring to 1 and 2, in operation, the dartboard 12 is preferably mounted to the wall of a room at a predetermined dartboard height. One of the preferred graphic panels 16 is positioned on the panel shelf 34 and is aligned relative to the aperture 14*a* by the panel alignment rib 32 when the pivoting lock arms 36 are in the release position (not shown). When the desired graphic panel 16 is properly mounted on the panel shelf 34, the plurality of additional graphic panels 16 may be mounted behind the graphic panel 16 or may be stored separately. The pivoting lock arms 36 are pivoted to the locking position to secure the graphic panel or plurality of graphic panels 16 to the frame 14. In this position, the desired graphic is exposed from the central aperture 14*a*. The frame 14 is then mounted to the dartboard 12 by engaging the concave surfaces of the first and second ribs 30*a*, 30*b* with the top edge 12*a* of the dartboard 12 such that gravity secures the frame 14 and graphic panel 16 to the dartboard 12. The top, first side and second side walls 20*a*, 20*b*, 20*c* may be engaged with the wall associated with the dartboard 12 and then slid down the wall until the first and second ribs 30*a*, 30*b* engage the top edge 12*a*. Alternatively, the user may urge the rear surface 18 toward or onto the front face of the dartboard 12 and then slide the frame 14 downwardly until the first and second ribs 30*a*, 30*b* engage the top edge 12*a*. The frame 14 is then oriented as desired by the user relative to the dartboard 12. As was described above, the rib 30 may be alternately constructed of pins that are urged into the dartboard 12 to secure the frame 14 to the dartboard 12 or hook and loop material that secure the frame 14 to the dartboard 12 or associated wall. In the mounted position, the graphic provides an aesthetically pleasing appearance in covering the dartboard 12 and may provide a functional attribute in that a score of the dart game may be kept on one of the display surfaces 16*a*, 16*b*. For example, the second display surface 16*b* may be utilized for keeping score and may be exposed from a rear of the frame 14 while the first graphic surface 16*a* which is exposed from the central aperture 14*a* to provide an aesthetically pleasing scene, picture or representation.

When a user intends to play a game of darts, the relatively lightweight dartboard cover 10 is removed from engagement with the dartboard 12 and placed to the side to expose the dartboard 12. The darts 28*a*, 28*b* are removed from the first and second dart holders 24, 26 to commence game play. In addition, as was described above, the specific graphic panel 16 or nearly any graphic panel 16 may be utilized to keep score during game play. In addition, following game play or at nearly any time, the plurality of graphic panels 16 may be interchanged to provide various ornamental appearances to the dartboard cover 10 by exposing various display surfaces 16*a*, 16*b* of the plurality of graphic panels 16 from the central aperture 14*a*. In addition, the darts 28*a*, 28*b* may be replaced in the first and second dart holders 24, 26 to maintain the darts 28*a*, 28*b* with the dartboard cover 10.

As is apparent to one having ordinary skill in the art, the dartboard cover 10 is relatively simple to use and inexpensive when compared to prior art dart cabinets. The graphic panels 16 permit inclusion of premium graphics on the display surfaces 16*a*, 16*b* and are adaptable for various uses and various types of graphics. Specifically, the graphic panels 16 provide for a nearly infinite number of graphic possibilities for inclusion with the dartboard cover 10. In addition, a user may purchase alternate graphic panels 16 following initial purchase of the dartboard cover 10 with different graphics on their surfaces for insertion into the dartboard cover 10. Further, the dartboard cover 10 is generally adaptable to numerous sized and shaped dartboards 12 by engaging the first and second ribs 30*a*, 30*b* with the top edge 12*a* of the dartboard 12 or otherwise engaging the frame 14 to the dartboard 12. Accordingly, a customer may choose which graphic they would like to display on the dartboard cover 10 by selecting a specific graphic panel 16 and a specific display surface 16*a*, 16*b*. A retailer may offer numerous graphic panels 16 with various graphics on either display surface 16*a*, 16*b* for sale to individual users that are adapted to the preferences of a user.

The dartboard cover 10 may further include a hook and loop material 38 mounted to the first and/or second ribs 30*a*, 30*b* that engage a complimentary hook and loop material 38 on the top edge 12*a* of the dartboard 12 to secure or more securely mount the dartboard cover 10 to the dartboard 12. The inclusion of the hook and loop material 38 on the ribs 30*a*, 30*b* and top edge 12*a* generally prevent the dartboard cover 10 from falling off of the dartboard 12 during normal use or when slightly jostled.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

We claim:

1. A dartboard cover for covering a dartboard in an aesthetically pleasing manner, the dartboard cover comprising:

a frame having a central aperture;

a rib extending from a rear surface of the frame, the rib being removably engagable with an upper edge of the dartboard to removably mount the dartboard cover to the dartboard;

a graphic panel removably mountable for exposure from the central aperture;

a panel alignment rib extending from a rear surface of the frame, the panel alignment rib and central aperture defining a panel shelf that receives the graphic panel in an assembled configuration; and a plurality of panel mounting mechanisms secured to the rear surface of the frame proximate the central aperture, the panel alignment rib including discontinuities to accommodate the panel mounting mechanisms.

2. The dartboard cover of claim 1 wherein the panel mounting mechanisms are comprised of a plurality of pivoting lock arms, the pivoting lock arms being pivotable between a locking position and a release position, the pivoting lock arms being oriented in the locking position and the graphic panel being positioned on the panel shelf in the assembled configuration to secure the graphic panel to the frame.

3. The dartboard cover of claim 1, wherein the frame includes a front wall accommodating the central aperture and having a rear surface, a first side wall, a second side wall and a top wall, the top wall having a generally arcuate-shape.

4. The dartboard cover of claim 1, wherein the rib is comprised of a first arcuate rib and a second arcuate rib extending from the rear surface, the first and second ribs conforming to the general shape of a top edge of the dartboard.

5. The dartboard cover of claim 1, wherein the frame includes a front wall, a first side wall, a second side wall and a top wall, the front, first side, second side and top walls being integrally molded using a polymeric material.

6. The dartboard cover of claim 5 further comprising:

stiffening ribs located between a front wall and top, first side and second side walls of the frame.

7. The dartboard cover of claim 1, wherein the graphic panel includes a first display surface and a second display surface, a first graphic being printed on the first surface.

8. The dartboard cover of claim 7 wherein the second display surface is comprised of one of a second graphic and a blank surface.

9. The dartboard cover of claim 1, wherein the graphic panel and the central aperture have a generally rectangular configuration, the graphic panel being larger than the central aperture.

10. The dartboard cover of claim 1, further comprising:

a first dart holder mounted to the frame; and a second dart holder mounted to the frame, the first and second dart holders accommodating darts for use with the dartboard.

11. The dartboard cover of claim 1, further comprising:

a plurality of additional graphic panels, the plurality of additional graphic panels being removably mountable to the frame to display a graphic surface from the central aperture.

12. A dartboard cover for covering a dartboard in an aesthetically pleasing manner, the dartboard cover comprising:

a frame having a central aperture in a front wall, a first side wall, a second side wall and a top wall;

a rib extending from a rear surface of the front wall, the rib being removably engagable with an upper edge of the dartboard to removably mount the dartboard cover to the dartboard;

a plurality of pivoting lock arms mounted to the rear surface proximate the central aperture; and a graphic panel removably mountable in the central aperture, the graphic panel being secured to the frame by the pivoting lock arms in an assembled configuration.

13. The dartboard cover of claim 12 wherein the pivoting lock arms are pivotable between a locking position and a release position, at least one of the lock arms being positioned in the locking position in the assembled configuration.

* * * * *